US009278245B2

(12) United States Patent
Marji

(10) Patent No.: US 9,278,245 B2
(45) Date of Patent: Mar. 8, 2016

(54) WEIGHTED EXERCISE VEST

(76) Inventor: Sammy Black Marji, Yonkers, NY (US)

( * ) Notice: Subject to any disclaimer, the term of this patent is extended or adjusted under 35 U.S.C. 154(b) by 631 days.

(21) Appl. No.: 13/068,456

(22) Filed: May 12, 2011

(65) Prior Publication Data

US 2012/0289385 A1 Nov. 15, 2012

(51) Int. Cl.

| | |
|---|---|
| ***A63B 21/065*** | (2006.01) |
| ***A63B 21/00*** | (2006.01) |
| ***A63B 23/04*** | (2006.01) |
| *A63B 22/20* | (2006.01) |

(52) U.S. Cl.

CPC ..... *A63B 21/065* (2013.01); *A63B 21/1415* (2013.01); *A63B 21/1465* (2013.01); *A63B 21/1488* (2013.01); *A63B 23/0405* (2013.01); *A63B 22/20* (2013.01); *A63B 2023/0411* (2013.01); *A63B 2208/0204* (2013.01); *A63B 2209/10* (2013.01)

(58) Field of Classification Search

CPC ..... A63B 23/04; A63B 23/0405; A63B 23/0411; A63B 21/065; A63B 21/1488; A63B 21/1415; A63B 21/068

USPC ..... 2/102, 455; 482/92, 95, 96, 105, 131, 482/132, 139, 93, 140, 136

See application file for complete search history.

(56) References Cited

U.S. PATENT DOCUMENTS

| | | | | |
|---|---|---|---|---|
| 3,796,431 | A * | 3/1974 | Sinyard | 482/132 |
| 4,382,302 | A * | 5/1983 | Watson | 2/102 |
| 5,632,707 | A * | 5/1997 | Daniel et al. | 482/8 |
| 6,510,560 | B1 * | 1/2003 | Ugolnik | 2/455 |
| 6,761,672 | B1 * | 7/2004 | Williams | 482/132 |
| 6,845,523 | B2 * | 1/2005 | Copp | 2/463 |
| 7,087,004 | B1 * | 8/2006 | Berke | 482/136 |
| 7,621,858 | B2 * | 11/2009 | Sheron | 482/132 |
| 2004/0153012 | A1 * | 8/2004 | Schroeder | 601/19 |

* cited by examiner

*Primary Examiner* — Loan H Thanh
*Assistant Examiner* — Nyca T Nguyen

(57) ABSTRACT

A method of performing a squatting exercise by an exerciser wearing a weighted vest, the vest has front and back portions and a panel member attached to the back portion of the vest, the panel member having one or more rows of roller-receiving cavities and a roller in each cavity for added weight. By placing the panel member between the back of a wall and an exerciser standing upright and pressing against the wall, the exerciser moves up and down during squat exercise to achieve maximum benefit from the exercise.

2 Claims, 3 Drawing Sheets

FIG. 3
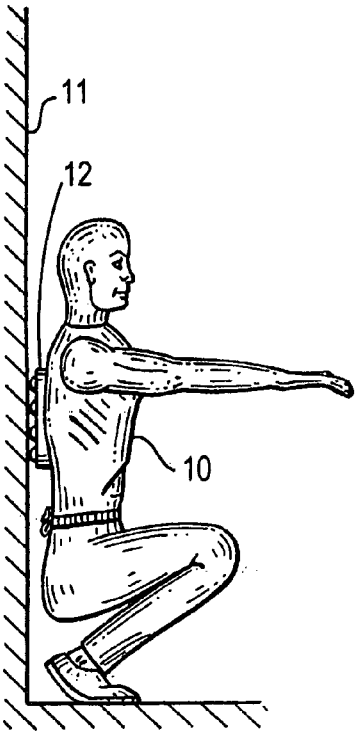
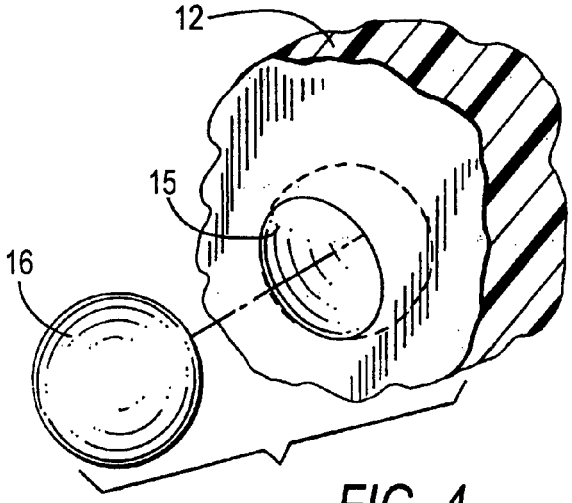
FIG. 4
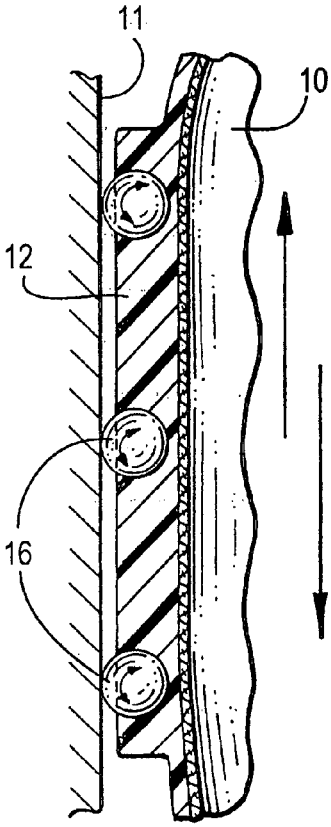
FIG. 5

FIG. 6
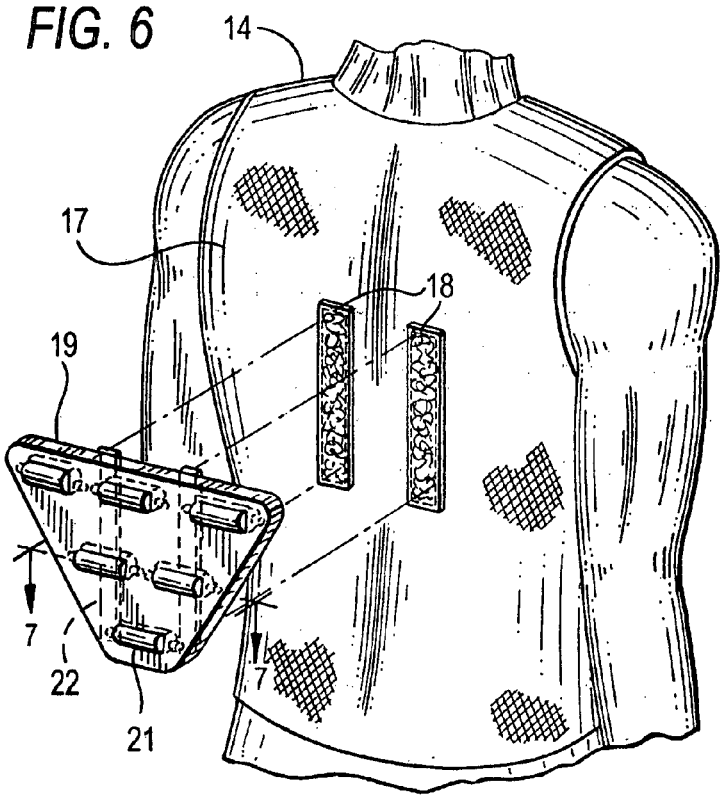
FIG. 8
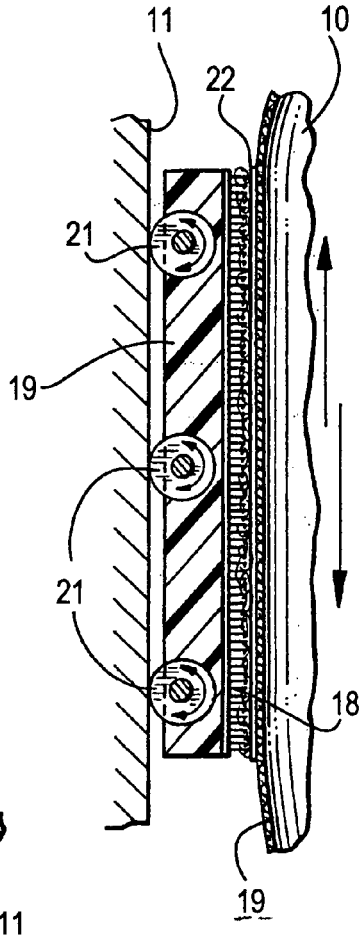
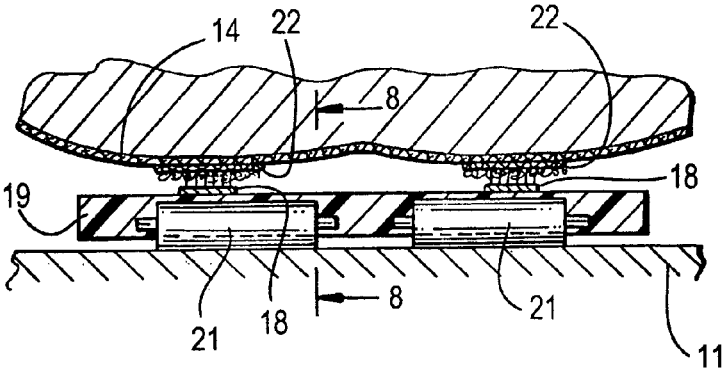
FIG. 7

WEIGHTED EXERCISE VEST

FIELD OF THE INVENTION

The present invention relates to exercise vests, and is particularly related to a weighted exercise vest for use during squat exercise.

BACKGROUND OF THE INVENTION

Exercise devices have become increasingly popular in recent years and a variety of exercise devices have been developed for use in different gyms, and some have even found their way in various homes. One popular exercise is doing squats, with or without devices which can be used to achieve maximum benefits from squat exercise. One such device is a vest, notably a weighted vest, which can be worn by the person during exercise. Several patents in recent years have disclosed a variety of exercise vests, including weighted vests, which have been worn by persons during squat exercise. One such exercise vest is disclosed in U.S. Pat. No. 4,344,620 issued Aug. 17, 1982. This patent describes a vest comprising several water-tight compartments for introducing water or other fluid into the compartments to increase the weight of the vest during exercise.

U.S. Pat. No. 4,989,267 issued Feb. 5, 1991 discloses a weighted training vest which includes front and rear interconnected panels having pocket-like recesses for receiving different weights.

U.S. Pat. No. 5,768,706 issued Jun. 22, 1998 describes a midi weighted jacket to be worn above the breast line during exercise. The front and back panels of the jacket comprise pockets for admitting and removing weights.

U.S. Pat. No. 6,209,135 issued Apr. 3, 2001 having right and left front panels connected to a back panel by elastic sides and webbing straps on top. A plurality of weight is irremovably received in the elastic pockets and is retained by elastic flaps over the pockets.

U.S. Pat. No. 7,490,361 issued Feb. 17, 2009 describes a weighted exercise vest which includes a plurality of pockets for holding small items and standard gym weights.

The vests described in the aforementioned patents have not been entirely satisfactory for use during squat exercise.

Therefore, it is an object of this present invention to provide a weighted exercise vest that is uniquely adapted for use during squat exercise.

The advantages of the weighted exercise vest of the present invention will be appreciated from the following detailed description of the invention and the accompanying drawings.

SUMMARY OF THE INVENTION

A weighted vest is provided which is particularly suitable for squat exercise The weighted vest has a front portion and back portion attached to the front portion. A panel member having a generally flat front surface is attached to the back portion of the vest, and a rear surface which has one or more rows of generally parallel roller-receiving cavities attached to the rear surface. Each roller-receiving cavity contains a roller for adding weight to the vest, the rollers being friction fitted within each roller-receiving cavity. During squat exercise, the panel member is placed between a wall and the back of the exerciser while the exerciser moves up and down for maximum benefit.

BRIEF DESCRIPTION OF THE DRAWINGS

In the drawings, wherein like reference numerals are employed to designate like parts:

FIG. 3 is a pictorial side view of the exerciser in FIG. 2 in squat position;

FIG. 4 is a view of the part of the triangular roller panel showing the roller cavity and removable roller;

FIG. 5 is a view taken along the line 5-5 in FIG. 1;

FIG. 6 is a view similar to FIG. 1 but showing the triangular roller panel removably attached by Velcro® strips to the Velcro® strips on the vest on the back of the exerciser;

FIG. 7 is a view taken along the line 7-7 of the triangular panel in FIG. 6, and FIG. 8 is a view taken along the line 8-8 in FIG. 7.

DETAILED DESCRIPTION OF THE INVENTION

Figure 1:
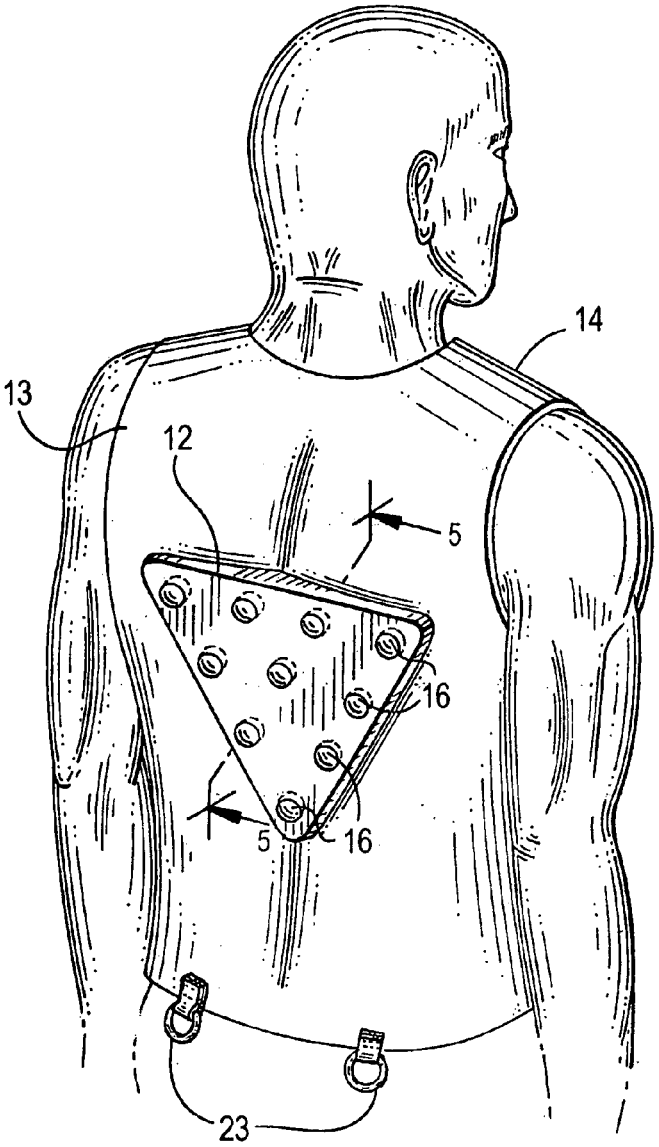
FIG. 1 is a pictorial view of the upper rear section of an exerciser showing a triangular roller panel attached to the back of the exercise vest.
Figure 2:
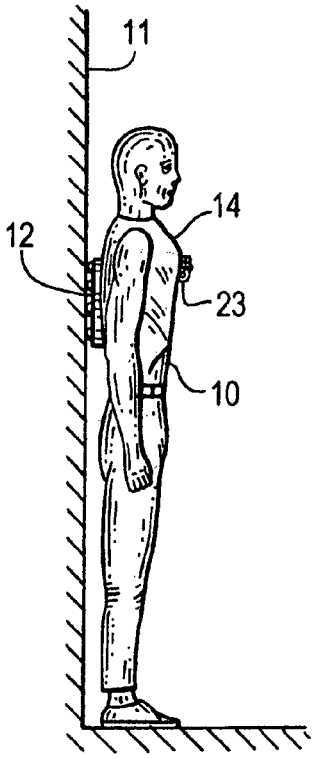
FIG. 2 is a pictorial side view of the exerciser in upright position with the triangular roller panel pressed against the wall by the back of the exerciser.

Referring to the drawings and first to FIGS. 1, 2 and 3, there is shown in FIG. 2 the exerciser 10 in upright position pressing against the wall 11 by the roller panel 12 disposed between the upper back 13 of the exerciser and the wall 11. The exerciser 10 is shown wearing an exercise vest 14 having an upper back section 13 with a triangular panel member 12 attached thereto as shown in FIG. 1 as well as in FIG. 6 (described hereinafter). The panel 12 is shown in triangular form with rows of roller cavities 15 for receiving removable rollers 16, as shown in FIG. 4. The roller cavities 15 are conveniently arranged in parallel rows, and during up and down movement of the exerciser, as in squatting, the rollers facilitate such movements. See FIG. 5.

In FIG. 1, the roller panel is shown with rows of roller cavities disposed in triangular arrangement. Other geometrical arrangements are suggested from this disclosure so long as the roller panel contains one or more rows of roller cavities containing rollers in order to impart added weight to the vest and facilitate up and down movement against a wall during squat exercise.

Referring to FIG. 6, the upper back section of the vest 17 is shown to include a pair of Velcro® strips 18,18 conveniently attached at about the middle of the upper back 17. A removable roller panel 19 having a plurality of rollers such as the barrel rollers 21 and Velcro® strips 22,22 may be conveniently attached to the back 17 of the vest by adhering the Velcro® strips 22,22 to the Velcro® strips 18,18, respectively. Other suitable strips of material having opposed hook and loop surfaces may be used. Velcro® is a trademark of Velcro USA. Inc., Manchester. N.H.

As in the embodiment shown in FIG. 1, in the weighted vest shown in FIG. 6 the barrel rollers re disposed in generally parallel rows, within roller—receiving cavities. In both embodiments, the exerciser will wear the weighted vest such that the weighted vest is pressed against the wall for moving up and down during squat exercise. By varying the number of rollers and/or their weights, the exerciser may maximize the benefits which can be derived from the use of the weighted vest.

Referring to FIG. 7, there is shown a removable roller panel 19 and the barrel rollers 21 wherein the roller panel 19 is attached to the vest by the Velcro strips 18,18 to the Velcro strips 22,22. The barrel rollers 21 shown in FIG. 8 are aligned in the removable roller panel 19 and further showing that the roller panel 19 is adhered by the Velcro strips 22,22 to the back of the vest.

In order to prevent the rollers from falling off the roller-receiving cavities, the rollers may be sized to friction fit within the roller cavities. Alternatively, the rollers may be covered by a fabric or a suitable elastic flap or cover which may be secured on the upper periphery of the cavities so as to securely retain each roller within its respective roller cavity.

In order to use the weighted vest for squat exercise, the roller panel containing the rollers in their cavities is attached to the upper back of the exerciser and pressed against the wall while the exerciser moves up and down as shown in FIGS. 1 and 3. The weight of the rollers and the number of rows on each roller panel can vary at the option of the exerciser.

Optionally, a pair of spaced apart o-rings 23,23 may be attached to the front or back of the vest for attachment to a rope or an elongated elastic member (not shown) for use during stretching or bending exercises.

The invention claimed is:

1. A method of performing a squatting exercise by an exerciser comprising the steps of:

providing a vest, said vest comprising a front portion and a back portion, said back portion having roller-receiving cavities, each of said cavities having a roller fitted therein;

said method further comprising the steps of:

wearing said vest;

performing the squatting exercise while wearing said vest, wherein the squatting exercise comprises the steps of:

standing up right against a vertical wall with the back portion of said vest facing said wall, wherein said rollers are in direct contact with said wall;

bending knees of said exerciser to perform a squat and then rising;

wherein the rollers of the vest aid the exerciser during squatting and rising cycles of said exercise.

2. The method as in claim 1 wherein each of said rollers is friction fitted in each of said roller-receiving cavities.

* * * * *